US005396704A

United States Patent [19]

Fiala et al.

[11] Patent Number: 5,396,704

[45] Date of Patent: Mar. 14, 1995

[54] END AND EDGE TRIMMING TOOL

[76] Inventors: Paul E. Fiala, 7205 Shadyoak Dr., Downey, Calif. 90240; Arthur W. Hicks, Jr., 6138 Fidler Ave., Lakewood, Calif. 90712; Harvey E. Fiala, 7205 Shadyoak Dr., Downey, Calif. 90240

[21] Appl. No.: 989,753

[22] Filed: Dec. 14, 1992

[51] Int. Cl.[6] ..... B26B 3/00; B26B 5/00; B26B 9/00

[52] U.S. Cl. ..... 30/299; 30/165; 30/173

[58] Field of Search ..... 30/114, 145, 146, 165, 30/226, 286, 287, 299, 304, 329, 359, 173

[56] References Cited

U.S. PATENT DOCUMENTS

| | | | |
|---|---|---|---|
| 1,263,253 | 4/1918 | Johns | 30/299 |
| 2,650,532 | 9/1953 | Moldowan | 30/299 |
| 4,078,308 | 3/1978 | Becker | 30/299 |
| 4,610,052 | 9/1986 | Lubcke | 30/299 |
| 5,003,696 | 4/1991 | Spehar | 30/299 |
| 5,010,650 | 4/1991 | Despins et al. | 30/299 |

*Primary Examiner*—Richard K. Seidel
*Assistant Examiner*—Paul M. Heyrana, Sr.
*Attorney, Agent, or Firm*—Robert M. Sperry

[57] ABSTRACT

A hand tool for end cutting and edge trimming of edge-banding, veneer and the like comprising a handle, a first generally L-shaped cutting blade mounted on said handle and having a curved cutting surface at the intersection of the legs thereof, together with a second blade extending obliquely across the axis of the tool and having the cutting edge of the second blade facing oppositely to the cutting edge of the first blade.

20 Claims, 6 Drawing Sheets

FIG. 11
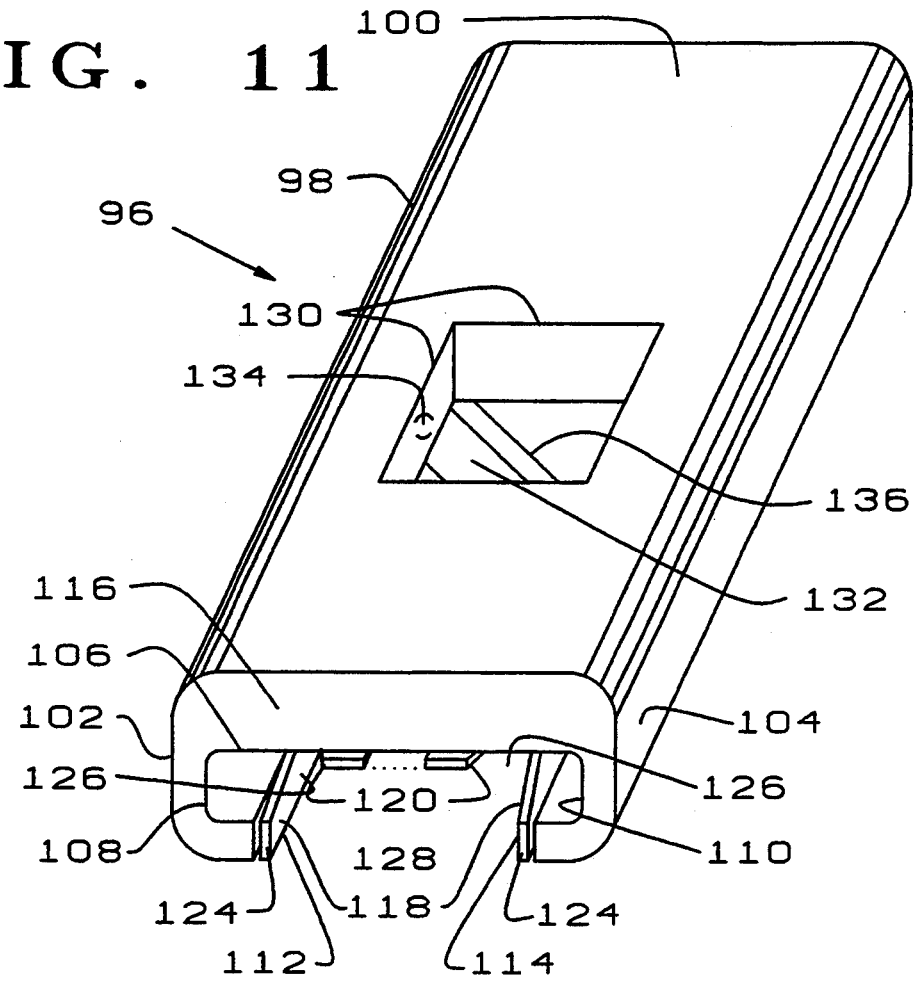
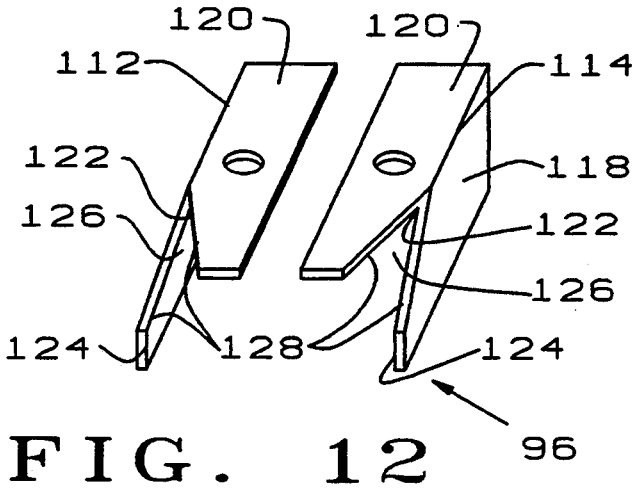
FIG. 12
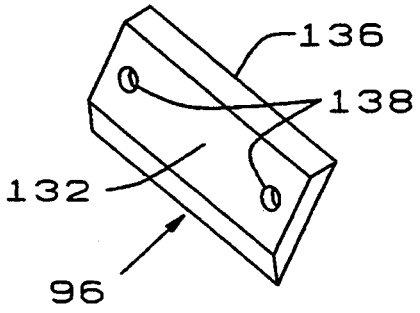
FIG. 13

END AND EDGE TRIMMING TOOL

BACKGROUND

1. Field of Invention

This invention relates to woodworking tools and is particularly directed to improved hand tools and bench tools for trimming the ends and edges of edgebanding materials.

A "Date of Conception Document" for this invention under the name of "END TRIMMER WITH EDGE TRIMMER" was disclosed to the Patent and Trademark Office and received by them on Aug. 3, 1992. It was assigned Disclosure Document No. 314639.

2. Prior Art

As is well known, modern furniture is generally formed with a substrate of particle board, plywood or the like, having a decorative surface veneer of wood, plastic or similar material, which is secured to the substrate by a suitable adhesive. Generally, the size of the sheet of veneer often does not precisely correspond with the size of the substrate, especially on edgebanding along the corners and edges of the tops of counters, tables, desks and the like. Therefore, it is usually necessary for the cabinetmaker to trim the excess veneer to fit the size of the substrate. Unfortunately, end trimming and edge trimming are very precise operations. If the cut is not close enough to the substrate, an undesired "lip" of veneer will project beyond the side edge of the article, which will be unsightly and which will tend to splinter when anyone brushes against it, causing painful injury to the person with the possibility of serious infection. On the other hand, if the cut is made too close to the substrate, a portion of the substrate will be exposed, which mars the desired uniform appearance of the veneer and removes the protection which the veneer provides to the substrate. Even when the cut is made precisely the proper length, it is generally necessary to finish the edges, as by bevelling, curving or sanding, to avoid sharp edges, which could cut or splinter.

Machines have been developed heretofore for performing such end trimming and edge trimming. However, most of these prior art machines are huge devices which may be of value in manufacturing plants, but which are extremely expensive and are not portable. Therefore, these machines cannot be transported to installation sites and, hence, are of little or no use to on-site cabinetmakers or carpenters. Some portable end cutting machines have been proposed. However, most of the prior art end cutting and edge trimming devices have been quillotine-type devices, which are useful in making only right-angle cuts, but which still require finishing by bevelling, curving, sanding, or the like. Furthermore, none of the prior art edge trimming and end trimming devices are useful with acute angles. In addition, many of the prior art end trimming and edge trimming devices are bulky and difficult to transport from one worksite to another. Other prior art devices are capable of either end trimming or edge trimming, but are not capable of performing both operations. Again, some of the prior art end trimming and edge trimming devices have been dangerous for the user. Still other prior art end trimming and edge trimming devices are expensive to purchase, are complex and difficult to use, and require considerable maintenance. Thus, none of the prior art end trimming and edge trimming devices have been entirely satisfactory.

BRIEF SUMMARY AND OBJECTS OF INVENTION

These disadvantages of the prior art are overcome with the present invention and improved end trimming and edge trimming tools are provided which are inexpensive to purchase, are simple and safe to operate, and can easily be transported between worksites, yet which assures accurate and proper edge trimming and end trimming at substantially any desired angle and which does not require additional finishing operations subsequent to the trimming.

The advantages of the present invention are preferably attained by providing a highly improved blade for a hand tool or bench tool for end trimming and edge trimming of edgebanding, veneer, and the like. The hand tool embodiment comprising a handle, a first generally L-shaped trimming blade mounted on said handle and having a curved trimming surface at the curved intersection of the legs thereof, together with a second blade extending obliquely across the axis of the tool and having the trimming edge of the second blade facing oppositely to the trimming edge of the first blade.

Accordingly, it is an object of the present invention to provide an improved hand tool.

Another object of the present invention is to provide an improved hand tool for end trimming and edge trimming of edge banding, veneer, and the like.

An additional object of the present invention is to provide an improved hand tool for end trimming and edge trimming of edge banding, veneer and the like which is inexpensive to purchase and which is simple and safe to use.

A further object of the present invention is to provide an improved hand tool for end trimming and edge trimming of edge banding, veneer and the like which is easily transportable between worksites.

Another object of the present invention is to provide an improved hand tool for end trimming and edge trimming of edge banding, veneer, and the like which assures accurate and proper edge trimming and end trimming at substantially any desired angle.

An additional object of the present invention is to provide an improved hand tool for end trimming and edge trimming of edge banding, veneer, and the like which does not require additional finishing operations subsequent to the trimming or trimming.

A specific object of the present invention is to provide a hand tool for end trimming and edge trimming of edgebanding, veneer and the like comprising a handle, a first generally L-shaped trimming blade mounted on said handle and having a curved trimming surface at the intersection of the legs thereof, together with a second blade extending obliquely across the axis of the tool and having the trimming edge of the second blade facing oppositely to the trimming edge of the first blade.

Another object of the present invention is to provide a highly improved blade for bench tools for end trimming and edge trimming of edgebanding, veneer and the like consisting of a generally L-shaped trimming blade having a curved trimming surface at the intersection of the legs thereof.

These and other objects and features of the present invention will be apparent from the following detailed description, taken with reference to the figures of the accompanying drawing.

BRIEF DESCRIPTION OF THE DRAWINGS

FIG. 11 is an isometric view of a further alternative form of the hand tool of FIG. 1;

FIG. 12 is an isometric view of the edge trimming blades of the hand tool of FIG. 11;

FIG. 13 is an isometric view of the end trimming blade of the hand tool of FIG. 11;

DETAILED DESCRIPTION OF THE INVENTION

Figure 1:
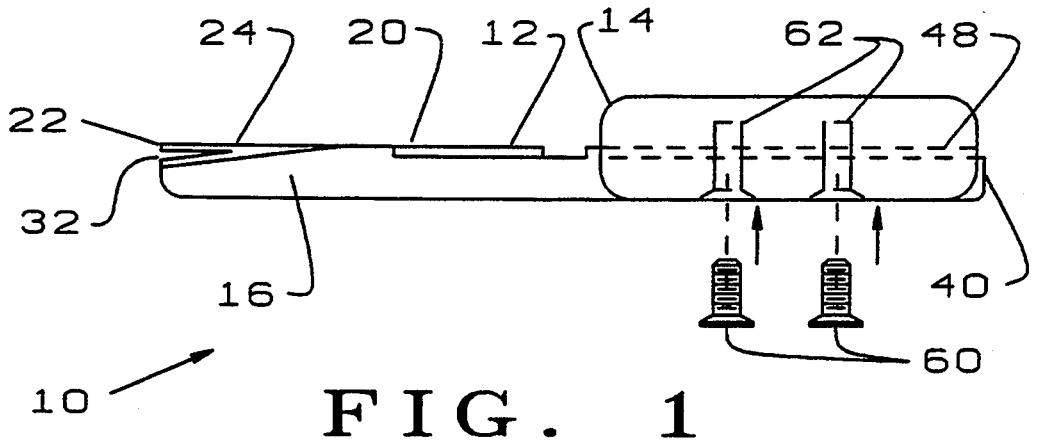
FIG. 1 is a side view of a hand tool embodying the present invention.
Figure 2:
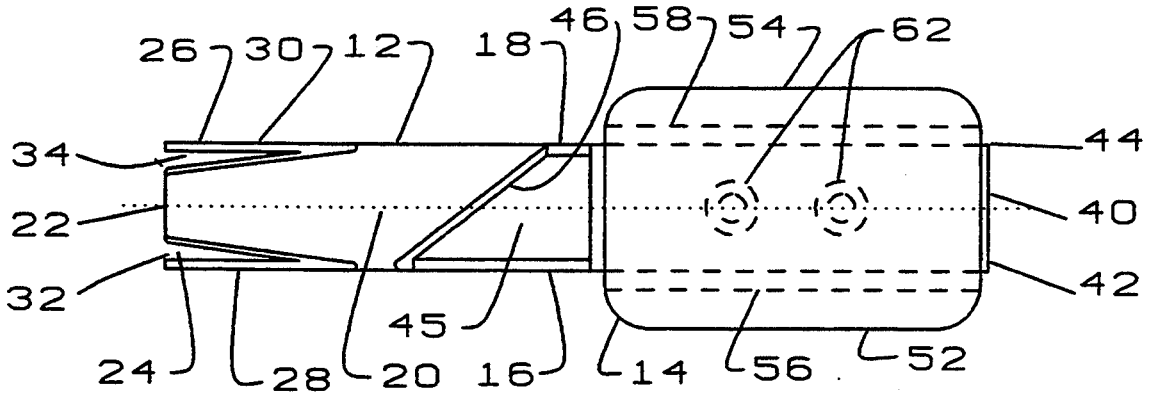
FIG. 2 is a top view of the hand tool of FIG. 1.
Figure 3:
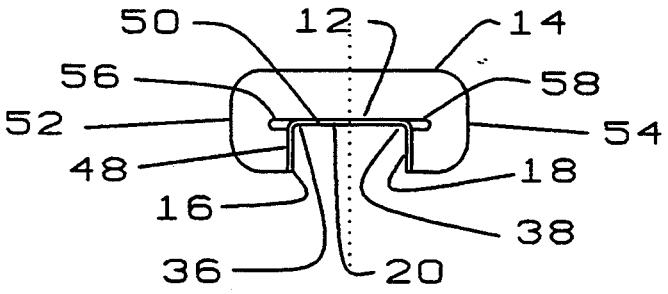
FIG. 3 is a right end view of the hand tool of FIG. 1.
Figure 4:
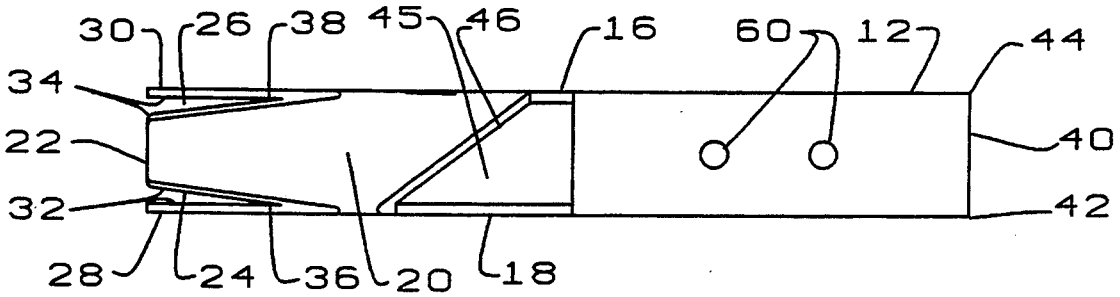
FIG. 4 is a top view of the hand tool of FIG. 1 with the handle removed for clarity.
Figure 4A:
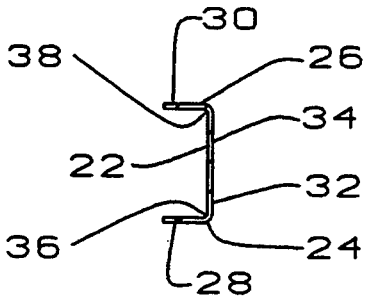
FIG. 4A is the left end view of the blade of FIG. 4.

In that form of the present invention chosen for purposes of illustration, FIGS. 1, 2 and 3 show a hand tool, indicated generally at 10, having a generally U-shaped blade member 12 and a handle 14. The blade member 12 is preferably formed of tool steel or the like, and has a pair of parallel legs 16 and 18 joined by a transverse portion 20. The U-shaped member is the equivalent of two generally L-shaped members joined together by the transverse portion. Obviously, the spacing between the legs 16 and 18 may be varied substantial- ly as desired to accommodate various sizes of work pieces. One end 22 of the transverse portion 20 is formed with a pair of recesses 24 and 26 separating end 22 from the adjacent portions 28 and 30 of the legs 16 and 18. Trimming edges 32 and 34 extend about the peripheries of the recesses 24 and 26, respectively, and have curved corners 36 and 38 at the intersection of the legs 16 and 18 with the transverse portion 20. Preferably, the radius of the curved corners 36 and 38 will be in the range of 0.02 to 0.05 inches for the most common edgebanding applications, but can vary all the way from 0.001 inche for thin wood grain tape to 1.00 inches for soft plastic edgebanding for children's furniture. The transverse portion 20 terminates at 40 inwardly of the ends 42 and 44 of the legs 16 and 18. To the right of recesses 24 and 26 and to the left of handle 14, the transverse member 20 has and opening 45 and a trimming edge 46 on one side of opening 45 and extending diagonally across between the legs 16 and 18 in window 45, as best seen in FIGS. 2 and 4. It should be noted that the trimming edge 46 faces oppositely to the trimming edges 32 and 34. The handle member 14 may be composed of any material which will be comfortable to the worker's hand, such as wood, metal, plastic, or the like, and has a generally U-shaped recess 48 extending along the underside 50 of the handle member 14, as best seen in FIG. 3, with side portions 52 and 54 which extend downwardly about the legs 16 and 18 of the blade member 12 and which have channels 56 and 58 extending along the intersections of the legs 16 and 18 with the transverse portion 20 of the blade member 12 to allow removal of trimmings removed by the blade member 12. As shown, the blade member 12 is attached to the handle member 14 by screws 60 which pass through suitable openings 62 formed in the transverse portion 20 of the blade member 12. However, it will be apparent that the blade member 12 could be secured to the handle member 14, by adhesive, by opening and snapping into place, or other suitable means, if desired.

In use, the hand tool 10 is placed on a workpiece with the edge of the workpiece inserted between the legs 16 and 18 and with the transverse portion 20 resting on the edge of the workpiece. The thickness of the edge of the thickest workpiece that can be trimmed will be equal to the spacing between legs 16 and 18 of the blade member 12. For the thickest workpiece, the worker may simply press the hand tool 10 against the edge of the workpiece and slide the hand tool 10 along the edge of the workpiece, in the direction of end 22 of the blade member 12. When this is done, the trimming surfaces 32 and 34 will trim the edges of the edgebanding and the curved corners will round the corresponding edges of the edgebanding to assure that the edgebanding is properly trimmed and that there are no sharp or splintered edges. If end trimming is necessary, the worker places end 40 of the blade member 12 on the workpiece adjacent the location where the edgebanding is to be end cut, with the edge of the workpiece inserted between the legs 16 and 18 and with the transverse portion 20 lying along the adjacent edge of the workpiece. Thereafter, by sliding the hand tool 10 toward the portion of the edgebanding to be cut, in the direction of end 40 of the blade member 12, the diagonal trimming surface 46 will sever the edgebanding with a quillotine action, as is well known. A major feature of the hand tool 10 lies in the fact that the diagonal trimming surface 46 faces oppositely from the trimming surfaces 32 and 34. Thus, when the hand tool 10 is moved toward end 22 of the blade member 12, trimming surfaces 32 and 34 will cut, but the diagonal trimming surface 46 will merely slide harmlessly over the edgebanding. Alternatively, when the hand tool 10 is moved toward end 40 of the blade member 12, the diagonal trimming surface 46 will serve to perform an end trimming operation, while trimming surfaces 32 and 34 slide harmlessly over the edgebanding. Thus, each of the trimming surfaces is effective only when the hand tool 10 is moved in the appropriate direction, but is incapable of harming the workpiece when the hand tool 10 is moved in the opposite direction.

In the event that the edge thickness of the workpiece is less that the spacing between the legs 16 and 18 of the blade member 12 of the hand tool 10, the worker inserts the edge of the workpiece between the legs 16 and 18 until the workpiece engages the transverse member 20 and lays one legs, for example leg 16, on the upper surface of the workpiece. Then, the worker moves the hand tool 10 along the edge of the workpiece in the direction of end 22, which causes trimming surface 32 to trim the edgebanding on the upper edge of the workpiece. Thereafter, the worker raises the hand tool 10 to bring leg 18 into engagement with the underside of the workpiece edge, which lifts leg 16 out of engagement with the upper surface of the workpiece; and again, moves the hand tool 10 along the workpiece in the direction of end 22. This serves to trim the edgebanding on the underside of the workpiece. Obviously, if the edge thickness of the workpiece is greater than the spacing between the legs 16 and 18 of the hand tool 10, a larger size of the hand tool 10 is required.

Figure 7:
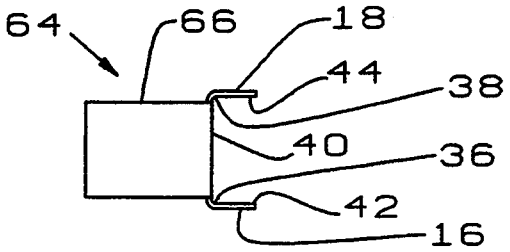
FIG. 7 is a right end view of the hand tool of FIG. 6.
Figure 5:
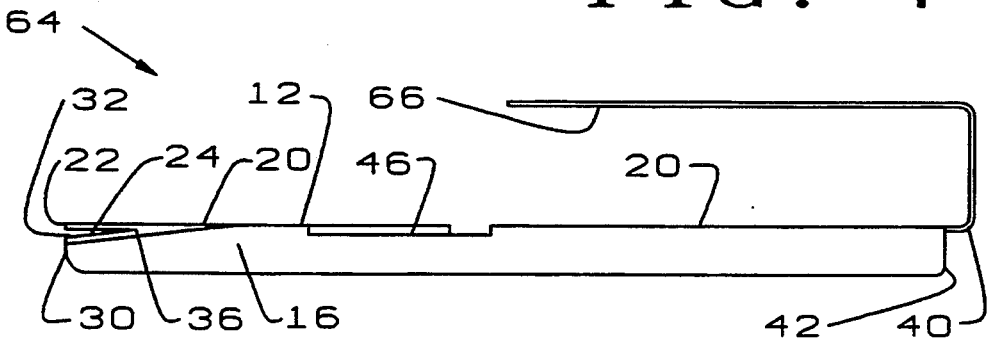
FIG. 5 is a side view of an alternative form of the hand tool of FIG. 1.
Figure 6:
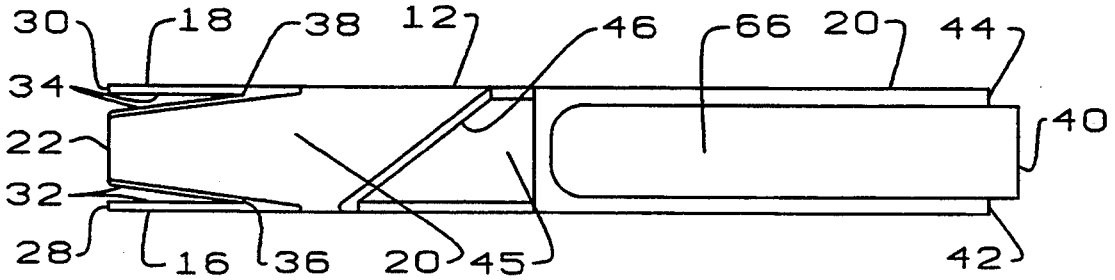
FIG. 6 is a top view of the hand tool of FIG. 5.

FIGS. 5, 6 and 7 show an alternative form indicated generally at 64, of the hand tool 10 of FIG. 1. The hand tool 64 of FIGS. 5–7 is substantially identical to the blade member 12 of the hand tool 10 of FIGS. 1–4 and like numbers designate like parts. The only difference is that end 40 of the hand tool 64 has a recurved portion 66 which extends upwardly and rearwardly to overlie the transverse portion 20 and to serve as a handle for the hand tool 64. The hand tool 64 functions in the same manner described above with respect to the hand tool 10 of FIGS. 1–5.

Figure 8:
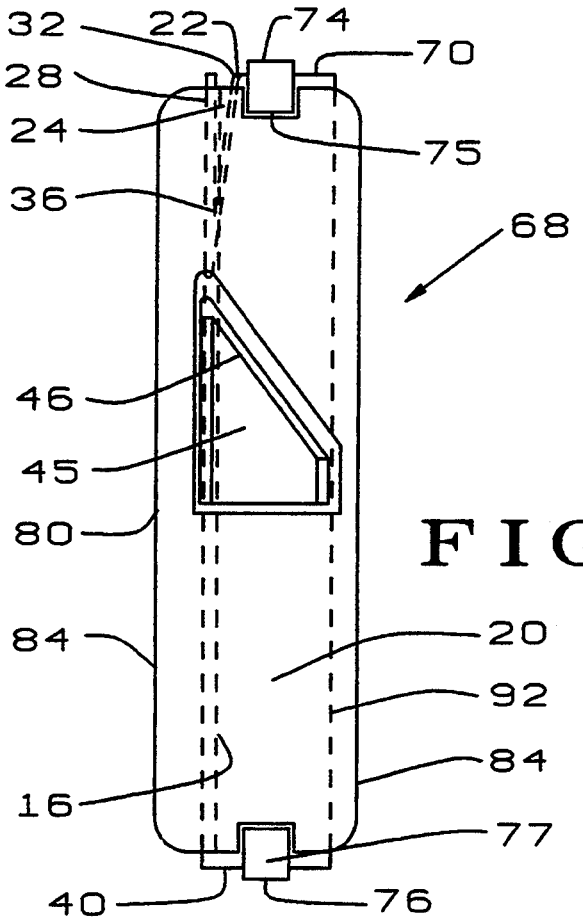
FIG. 8 is a top view of another alternative form of the hand tool of FIG. 1.
Figure 9:
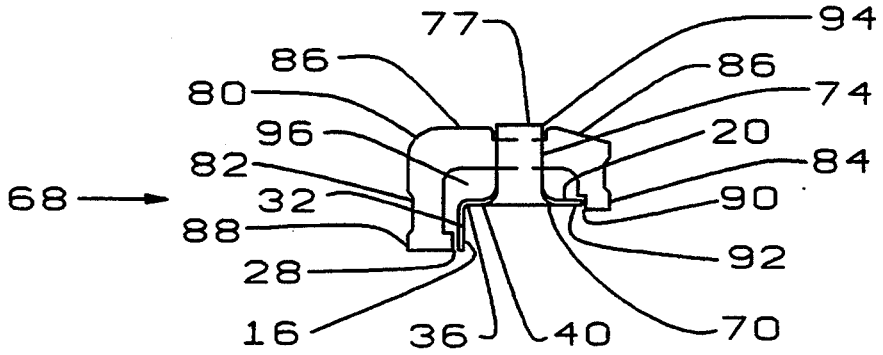
FIG. 9 is an end view of the hand tool of FIG. 8.
Figure 10:
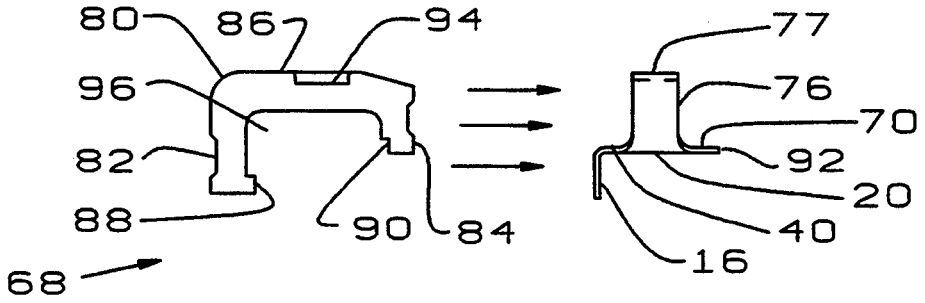
FIG. 10 is an exploded end view of the hand tool of FIG. 8.

FIGS. 8, 9 and 10 show another alternative form, indicated generally at 68, of the hand tool 10 of FIGS. 1–5. In this form of the present invention, a blade member 70 is provided, which is generally L-shaped, having a leg 16 extending perpendicularly from a transverse portion 20, with vertical members 74 and 76 which extend upward from each end 22 and 40 of the blade member 70. End 22 of blade member 70 is formed with a recess 24 having sharpened edges which forms a trimming surface 32 along the adjacent edges of leg 16 and transverse portion 20 and has a curved inner corner 36 at the intersection of leg 16 with transverse portion 20. At a desired distance from end 22 of the blade member 70 in window 45, a second trimming edge 46 extends diagonally across the blade member 70, with the trimming edge 46 facing oppositely to the trimming surface 32 of end 22 of the blade member 70. An elongated handle member 80 is provided, which is generally C-shaped in cross-section, as best seen in FIGS. 9 and 10, having a pair of vertical legs 82 and 84 joined by a transverse portion 86. The handle member 80 is formed of somewhat resilient material and leg 82 is somewhat longer than leg 84 and has a lower lip 88 which projects inwardly to engage the lower edge of leg 16 of the blade member 70, while leg 84 is formed with a recess 90 in its lower surface to releasably receive edge 92 of the transverse portion 20 of the blade member 70. Finally, each end of the transverse portion 86 of the handle member 80 is provided with a short longitudinal recess 94 to releasably receive the upper tabs, 75 and 77 on vertical members 74 and 76 respectively, of the blade member 70. To assemble the handle member 80 with the blade member 70, the handle member 80 is inserted between the horizontal tabs 75 and 77 and the transverse portion 20 of the blade member 70 until tabs 75 and 77 snap into place in the recess 94 of the transverse portion 86 of the handle member 80, and the blade member 70 snaps into recess 90 in the lower end of leg 84 of the handle member 80, while lip 88 of leg 82 of the handle member 80 engages the lower edge of the leg 16 of the blade member 70. As best seen in FIG. 9, the legs 82 and 84 of the handle member 80 cause the transverse portion 86 of the handle member 80 to be spaced above the transverse portion 20 of the blade member 70 to define a space 96 between the handle member 80 and the blade member 70 which serves to allow removal of trimmings.

In use, the handle member 80 is attached to the blade member 70 by inserting the leg 84 and horizontal portion 86 of the handle member 80 between the horizontal tab 77 and the transverse portion 20 of the blade member 70 until the horizontal tab 77 of the blade member 70 snaps into recess 94 of the transverse portion 86 of the handle member 80. Edge 92 of the transverse portion 20 of the blade member 70 will snap into recess 90 in the lower end of leg 84 of the handle member 80. Lip 88 of leg 82 of the handle member 80 will engage the lower edge of leg 16 of the blade member 70. Thereafter, the worker places the hand tool 68 on the workpiece with leg 16 of the blade member 70 lying on an edge of the workpiece which is to be trimmed and with the transverse portion 20 of the blade member 70 lying on the surface of the workpiece adjacent to the edge which is to be trimmed. Thereafter, the worker moves the hand tool 68 in the direction of end 22 of the blade member 70 causing the trimming surface 32 to trim the edge of the workpiece and causing the curved corner 36 to round the corner of the workpiece edge to avoid splinters or sharp edges. For end trimming, the hand tool 68 is used in the same manner as described above the hand tool 10 of FIGS. 1–5.

FIGS. 11, 12 and 13 show another alternative form, indicated generally at 96, of the hand tool 10 of FIGS. 1–5. In this form of the present invention, a handle member 98 is provided having a horizontal portion 100 with a pair of side members 102 and 104 extending downward from each edge of the horizontal portion 100 to define a rectangular channel 106, which extends the entire length of the handle member 98. A pair of generally semi-circular channels 108 and 110 extend along the rectangular channel 106 at the intersections of the side members 102 and 104 with the horizontal portion 100 to provide for removal of trimmings. A pair of blade inserts 112 and 114 are provided and are releasably secured, by suitable means such as screws, not shown, to the handle member 98 adjacent one end 116 of the rectangular channel 106. Each of the blade inserts 112 and 114 is generally L-shaped or right-angled, having a horizontal portion 120 and a vertical portion 118, and is formed with a recess 122 extending inwardly from one end 124 of the insert 112 and 114 along the intersections 122 of the horizontal portion 120 and vertical portion 118, as best seen in FIG. 12. The edges of the recesses 126 are sharpened to form trimming surfaces 128 and the intersections 122 are curved to cut smooth, rounded corners. It should be noted that the recesses 126 of both of the blade inserts 112 and 114 face toward end 116 of the rectangular channel 106 of the handle member 98. The handle member 98 also has a window 130 formed in the horizontal portion 100 of the handle, communicating with the rectangular recess 106 and a third blade insert 132 is releasably secured to the handle member 98 by suitable means, such as screws 134 passing through suitable holes 138 in the blade insert 132, and has a trimming surface 136 facing in the direction opposite that of the trimming surfaces 128 of the blade inserts 112 and 114. In use the hand tool 96 functions in the same manner as described above with respect to the hand tool 10 of FIGS. 1–5.

Figure 14:
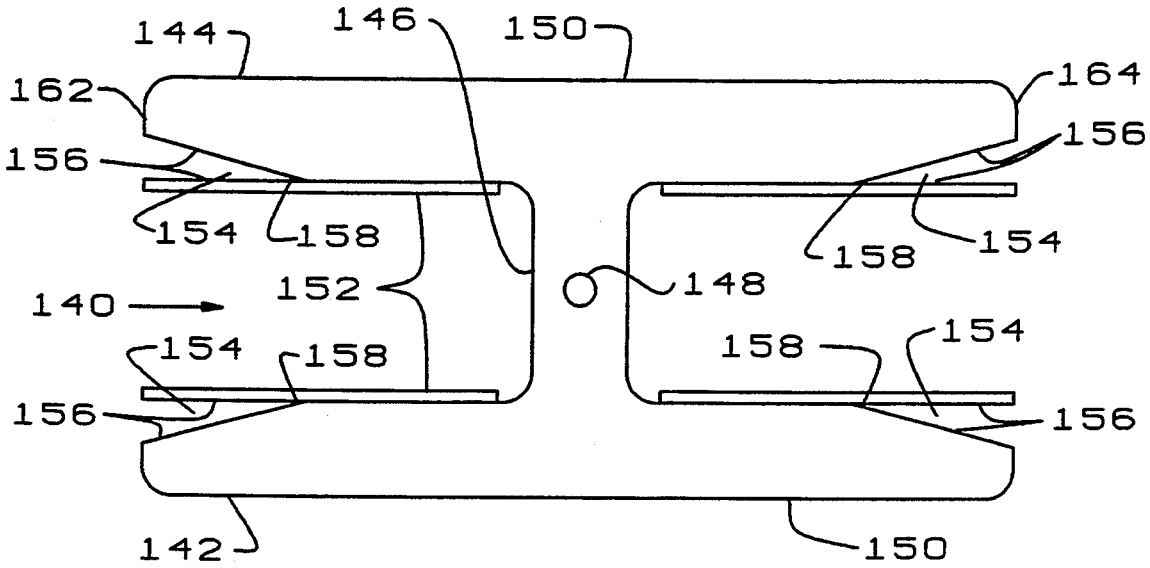
FIG. 14 is a plan view of another alternative form of replacement blade for exiting hand tools.
Figure 15:
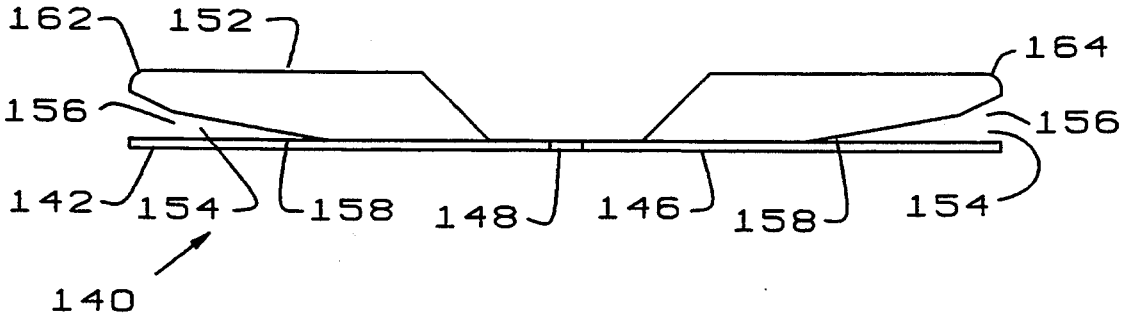
FIG. 15 is a side view of the blade of FIG. 14.
Figure 16:
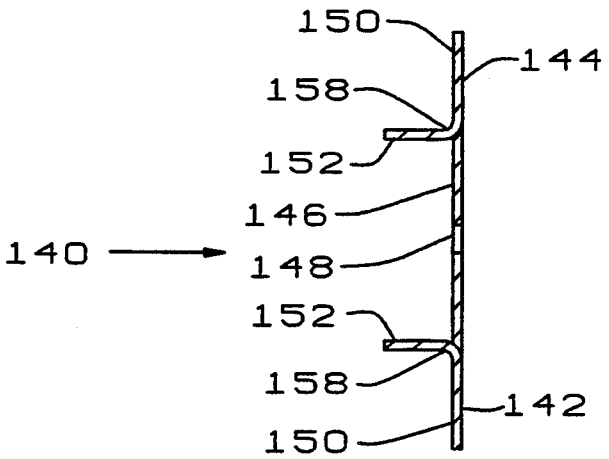
FIG. 16 is an end view of the blade of FIG. 14.

FIGS. 14, 15 and 16 show the top, front, and right end, respectively, of an additional alternative form, indicated generally at 140, of the blade member 12 of FIGS. 1–5. The blade member 140 is generally H-shaped, as seen in FIG. 14, having two right-angular or L-shaped legs 142 and 144 joined by a central transverse member 146 formed with a hole 148 to facilitate securing the blade member 140 to a handle member, such as a modified version of handle member 14 of FIG. 1, by suitable means, such as screws, not shown. Each of the L-shaped legs 142 and 144 has a horizontal portion 150, which is coplanar with the transverse member 146, and a vertical portion 152, extending perpendicular to the horizontal portion 150. Recesses 154 extend inwardly from each end of the legs 142 and 144 and the edges of the recesses 154 are sharpened to form trimming surfaces 156. The intersections of the horizontal portions 150 with the vertical portions 152 of the legs 142 and 144 are curved to provide curved intersections 158. It should be noted that the trimming surfaces 156 face toward the adjacent ends 162 and 164 of the blade member 140. Thus, movement of the blade member 140 toward end 162 will cause the adjacent trimming surfaces 156 to perform a trimming operation, while the trimming surfaces 156 adjacent the opposite end 164 of the blade member 140 will slide harmlessly along the workpiece. Alternatively, movement of the blade member 140 toward end 164 will cause the adjacent trimming surfaces 156 to perform a trimming operation, while the trimming surfaces 156 adjacent the opposite end 162 of the blade member 140 will slide harmlessly along the workpiece.

In use, the worker places the blade member 140 on a horizontal edge of a workpiece with the vertical portion 150 of one of the legs 142 and 144 pressed against a vertical surface of the workpiece and the horizontal portion 152 of the same leg 142 and 144 resting on the horizontal edge of the workpiece, straddling the edge of the workpiece which is to be trimmed. Thereafter, the worker may move the blade member 140 toward either end 162 or 164, causing the adjacent trimming surface 156 to trim the edgebanding along the desired edge of the workpiece.

By suitable design of two mating handle members, such as a variation of handle member 14 of FIG. 1, each of which contains blade member 140, the handle members can be compressed together to trim both edges of the workpiece at the same time, resulting in a variable width hand trimmer that can edge trim both edges of a workpiece at the same time.

For handle configurations that are compressible and contain two blades members 140, the worker places one side of both blade members on one edge of the workpiece, compresses the two halves of the handle together, and moves the tool toward either end of the workpiece, trimming both sides of the edgebanding at the same time. By going back and forth several times, while trimming in each direction, a perfect job of edge trimming with the highly desired rounded edges is accomplished.

Figure 17:
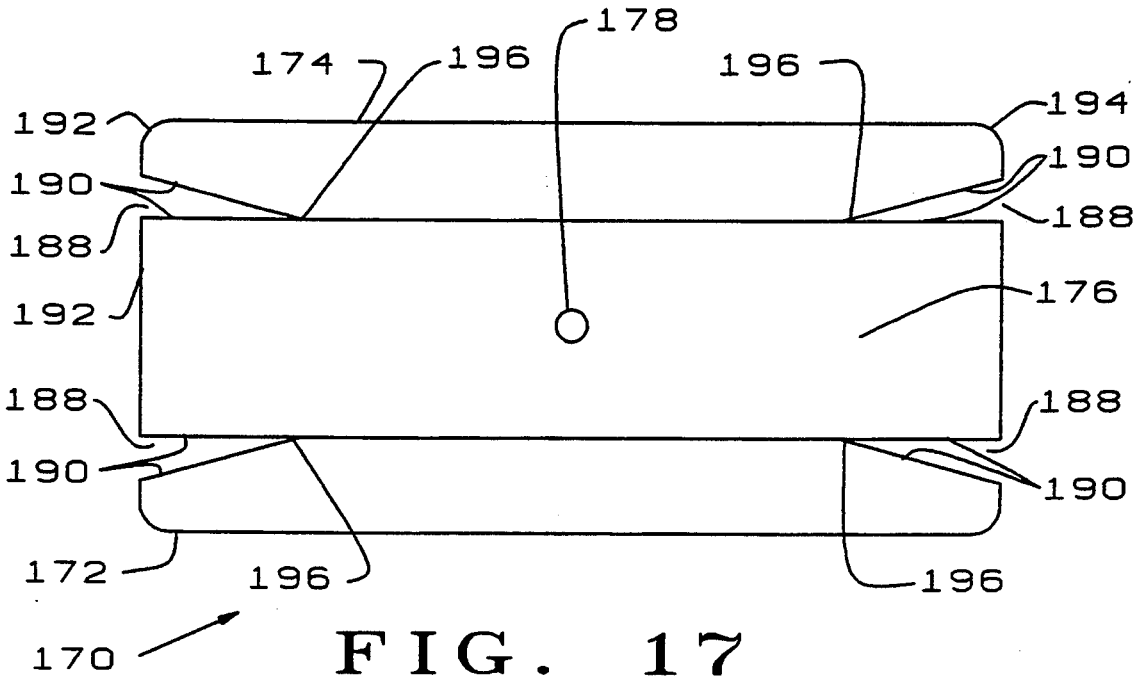
FIG. 17 is a plan view of another alternative form of replacement blade for the existing hand tools.
Figure 18:
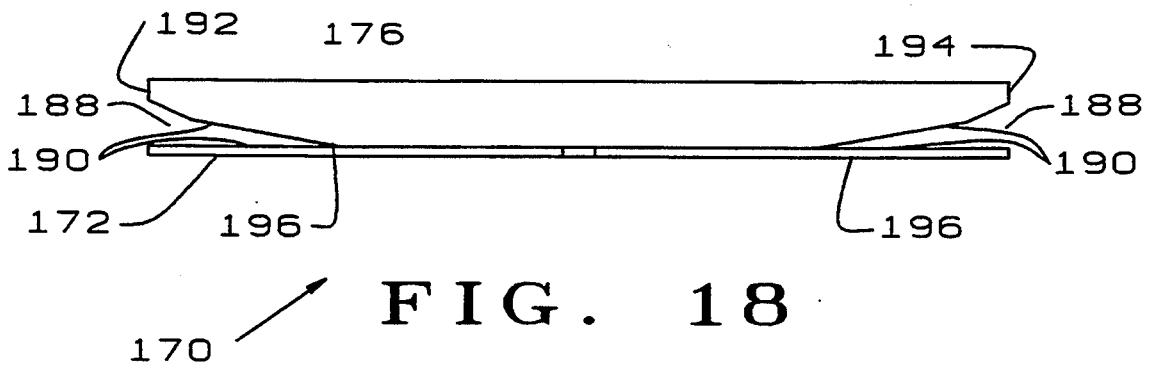
FIG. 18 is a front side view of the blade of FIG. 17.
Figure 19:
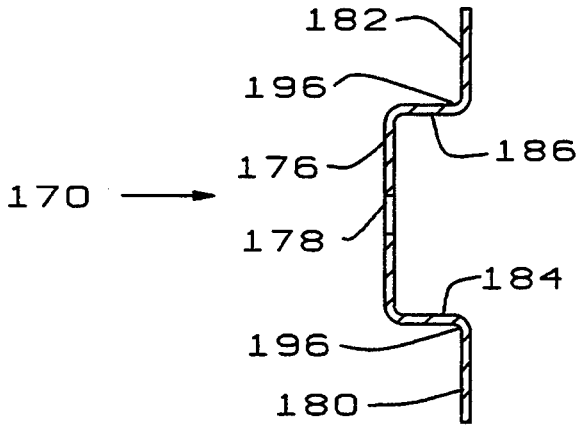
FIG. 19 is an end view of the blade of FIG. 17.

FIGS. 17, 18 and 19 show the top, front, and right end views, respectively, of still an another alternative form, indicated generally at 170, of the blade member 12 of FIGS. 1–5. The blade member 170 is generally hat-shaped, as seen in FIG. 19, having two right-angular or L-shaped legs 172 and 174 joined by a central transverse member 176 formed with a hole 178 to facilitate securing the blade member 170 to a handle member, such as a modified handle member 14 of FIG. 1, by suitable means, such as screws, not shown. Each of the L-shaped legs 172 and 174 has a horizontal (as shown in FIG. 19) portion (184 and 186) which is perpendicular to the transverse member 176, and a vertical portion (180 and 182). Recesses 188 extend inwardly from each end of the legs 172 and 174 and the edges of the recesses 188 are sharpened to form trimming surfaces 190. The intersections of the horizontal portions 184 and 186 with the vertical portions 180 and 182 of the legs 172 and 174 are curved to provide curved trimming surfaces 190. It should be noted that the trimming surfaces 190 face toward the adjacent ends 192 and 194 of the blade member 170. Thus, movement of the blade member 170 toward end 192 will cause the adjacent trimming surfaces 190 to perform a trimming operation, while the trimming surfaces 190 adjacent the opposite end 194 of the blade member 170 will slide harmlessly along the workpiece. Alternatively, movement of the blade member 170 toward end 194 will cause the adjacent trimming surfaces 190 to perform a trimming operation, while the trimming surfaces 190 adjacent the opposite end 192 of the blade member 170 will slide harmlessly along the workpiece.

In use, the worker places the blade member 170 on a horizonyal edge of a workpiece with the vertical portion 180 or 182 of one of the legs 172 or 174 pressed against a vretical surface of the workpiece and the horizontal portion 184 or 186 of the same leg 142 or 144 resting on the horizontalo edge of the workpiece, straddling the edge of the workpiece which is to be trimmed. Thereafter, the worker may move the blade member 170 toward either end 192 or 194, causing the adjacent trimming surface 190 to trim the edgebanding along the desired edge of the workpiece.

By suitable design of two mating handle members, such as modified versions of handle member 14 of FIG. 1, each of which contains blade member 170, the handle members can be compressed together to trim both edges of the workpiece at the same time.

For handle configurations that are compressible and contain two blades members 170, the worker places one side of both blade members on one edge of the workpiece, compresses the two halves of the handle together, and moves the tool toward either end of the workpiece, trimming both sides of the edgebanding at the same time. By going back and forth several times, while trimming in each direction, a perfect job of edge trimming with rounded edges is accomplished.

Obviously, numerous other variations and modifications can be made without departing from the spirit of the present invention. For example, the curved cutting surface of the blade can be formed from a bend whose curve is part of a circle, an ellipse, a parabola, a logarithmic curve, a sine wave, or any number of different mathematical curves, all producing approximately the same highly desired nicely rounded edge on furniture. This invention is intended to cover all sizes and shapes of curves for the cutting surfaces. Therefore, it should be clearly understood that the forms of the present invention described above and shown in the figures of the accompanying drawing are illustrative only and are not intended to limit the scope of the present invention.

What is claimed is:

1. A blade for a tool comprising:

said blade being generally H-shaped having a pair of L-shaped members each having a first portion and a second portion extending perpendicularly to each other, and a recess extending inwardly from at least one end of at least one of said L-shaped member with the edge of said recess being sharpened to form a curved trimming surface.

2. The blade of claim 1 wherein:

the edge of said recess at the intersection of said first and second portions being curved.

3. The blade of claim 2 wherein:

the radius of said curved intersection is 0.001 to 0.500 inches.

4. The blade of claim 1 further comprising:

said blade is generally U-shaped in cross-section having a pair of said L-shaped members joined by a transverse portion connecting the horizontal portions of said L-shaped members.

5. The blade of claim 1 further comprising:

a second trimming surface extending diagonally across said transverse member with said second trimming surface facing in a direction opposite from that of the trimming surface of said recess.

6. The blade of claim 1 wherein:

said blade has recesses extending inwardly from each end of said L-shaped member with the edge of each of said recesses being sharpened to provide trimming surfaces facing in opposite directions.

7. The tool of claim 1 wherein:

a handle releasably secured to said blade.

8. The tool of claim 7 wherein:

said handle is an extension of said blade which is recurved to lie substantially parallel to one portion of said blade.

9. The tool of claim 7 wherein:

a pair of said blades are releasably secured to said handle with the recesses of each of said blades facing toward a common end of said handle.

10. The tool of claim 7 wherein:

said handle is generally U-shaped in cross-section having a transverse portion engaging said first portion of said blade and having a side portion engaging said second portion of said blade.

11. The tool of claim 7 further comprising:

said handle being generally U-shaped in cross-section having a channel extending longitudinally the entire length of said handle and having said blade mounted within said channel adjacent one end thereof.

12. The tool of claim 7 wherein:

the edge of said recess of said blade at the intersection of said first and second portions being curved.

13. The tool of claim 12 wherein:

the radius of said curved intersection is 0.001 to 0.500 inches.

14. The tool of claim 12 wherein:

said handle consists of two movable pieces, each of which contains at least one of said L-shaped blade portions possessing a curved cutting surface.

15. The blade of claim 7 further comprising:

a second cutting surface formed on said first portion of said blade member extending diagonally across said first portion and facing in a direction opposite from said cutting surface of said recess.

16. The tool of claim 7 wherein:

said blade is resiliently attached to said handle.

17. The tool of claim 7, wherein:

said handle has a curved surface suitable for pressing on the material being bonded.

18. The tool of claim 7 wherein:

said handle is shaped to form a guard to minimize contact with the cutting surface of said blade.

19. The blade of claim 7 further comprising:

said blade is generally hat-shaped in cross-section having a pair of said L-shaped members joined by a transverse portion connecting the vertical portions of said L-shaped members.

20. A hand tool comprising:

a handle, at least one blade member mounted on said handle and having a first portion and a second portion extending perpendicularly to each other, a recess extending inwardly from at least one end of said blade member with the edge of said recess being sharpened to form a trimming surface, said handle having a window formed therein and having an additional blade within said window extending diagonally across said handle and having the trimming surface of said additional blade facing opposite to the trimming surface of said recess.

* * * * *